United States Patent [19]

Kuroda et al.

[11] Patent Number: 4,567,721

[45] Date of Patent: Feb. 4, 1986

[54] METHOD FOR PRODUCING TEXTURED YARN

[75] Inventors: Toshimasa Kuroda, Takatsuki; Yoshihiko Maezawa, Kyoto; Terukuni Ikuta, Takatsuki, all of Japan

[73] Assignee: Teijin Limited, Osaka, Japan

[21] Appl. No.: 663,302

[22] Filed: Oct. 22, 1984

[30] Foreign Application Priority Data

Nov. 1, 1983 [JP] Japan ..... 58-203678
Jul. 2, 1984 [JP] Japan ..... 59-135257

[51] Int. Cl.[4] ..... D02G 1/04
[52] U.S. Cl. ..... 57/284
[58] Field of Search ..... 57/282, 284, 290, 336

[56] References Cited

U.S. PATENT DOCUMENTS

| | | | |
|---|---|---|---|
| 2,952,116 | 9/1960 | Burlesow | 57/290 X |
| 3,724,196 | 4/1973 | Holland et al. | 57/284 |
| 4,296,598 | 10/1981 | Faure | 57/284 |
| 4,384,494 | 5/1983 | Taylor | 57/336 X |
| 4,456,818 | 6/1984 | McCollough | 57/284 X |

*Primary Examiner*—Donald Watkins
*Attorney, Agent, or Firm*—Burgess, Ryan & Wayne

[57] ABSTRACT

A method for producing a textured polyester yarn, especially in an in-draw texturing system, in which starting yarn is processed by means of a non-touch type heater under a heater temperature in a range of from 350° C. to 800° C. and a shorter processing time in a range of from 0.04 second to 0.12 second. The dyeing evenness of the fabric made from the resultant yarn is improved because the dyeability of the yarn is almost constant despite fluctuation of the heater temperature. A belt-type twister is preferably utilized for false-twisting a yarn rather than a disc type.

4 Claims, 13 Drawing Figures

METHOD FOR PRODUCING TEXTURED YARN

BACKGROUND OF THE INVENTION

1. Field of the Invention

The present invention relates to a method for producing a textured yarn by false-twisting polyester filament yarn. Particularly, it relates to a so-called in-draw system, in which a partially oriented polyester yarn (hereinafter referred to as POY) is simultaneously drawn and false-twisted in the heat-setting zone.

2. Description of the Prior Art

In a conventional false-twist texturing system for polyester filament yarn, a primary heater is utilized for heat-setting a truly twisted portion of the yarn. Most such heaters are of a contact type comprising a heater plate energized by a heating medium such as Dowtherm® or by a wire embedded therein. The heater plate has a curved surface and groove provided thereon for retaining the yarn on the heater surface and preventing the yarn from leaving the yarn path due to the torque imparted by the twist. As the heat-set conditions for polyester yarn in the conventional false-twist texturing system, a heater temperature less than 250° C. and a processing time more than 0.17 second are set. These conditions are considered common sense for those skilled in the art as described in pages 90 to 94 of "Technical Mannual for Filament Processing" vol I, published on May 15, 1976 by the Textile Machinery Society of Japan.

The conventional texturing system utilizing a contact-type heater suffers from some problems, however. The graph of FIG. 1*a* shows the crimpability and dyeability of the conventional textured yarn relative to the heater temperature. As clear from the graphs, the crimpability appears to have a peak for a specific heater temperature X, while the dyeability has a valley for another heater temperature Y. Naturally, the differential coefficients of these parameters relative to the heater temperature are almost zero in the vicinity of the peak or valley. Therefore, even if the heater temperature fluctuates somewhat around that point, the value of the parameter remains almost the same. Thus, an even yarn quality can be expected from a process carried out under such a peak or valley temperature. On the other hand, since the differential coefficient of the parameter becomes larger as the temperature is farther from the peak or valley, when the process is carried out under a temperature in a region away from the peak or valley, the parameter tends to vary largely even with subtle temperature fluctuations.

As also apparent from FIG. 1*a*, the temperature Y under which the dyeability of the yarn becomes minimum is lower than the temperature X for the maximum crimpability. Since yarn processed under such a lower temperature Y is liable to lack bulkiness and fabric obtained therefrom tends to present a poor hand after post heat-treatment such as dyeing or heat-setting, the temperature Y is not preferable as a heater temperature for the texturing process. In practice, therefore, the higher temperature X is utilized. However, under conventional conditions, there is a relatively large difference between the temperatures X and Y. This means the fluctuation of the heater temperature may be reflected in the dyeability of the resultant yarn.

To overcome the above problems, it has been proposed to use a non-touch type heater, instead of contact-type, i.e., a heater through which the yarn can pass without contacting the heater surface. With a non-touch type heater, however, it is difficult to control a balloon of yarn in the heater zone whereupon the heat-setting effect of the yarn becomes irregular. Moreover, in the prior art, more than 0.2 second processing time is thought to be necessary for the yarn in the heater, even in the case of a non-touch type heater. Therefore, the heater temperature must be lower than 350° C. to protect the yarn from heat damage. In such a lower temperature region, however, the crimpability and dyeability of the textured yarn relative to the heater temperature are not improved even by the utilization of a non-touch type heater.

SUMMARY OF THE INVENTION

It is an object of the present invention to provide a false-twist texturing system in which the peak temperature X for the crimpability and the valley temperature Y for the dyeability are closer to each other and curves for the crimpability and the dyeability relative to the heater temperature are flatter compared to those of the conventional system.

It is another object of the present invention to provide a false-twist texturing system in which a non-touch type heater of relatively short length can be utilized even under a high processing speed.

The above objects are achievable by a method for producing a textured yarn of polyester filament according to the present invention, wherein a polyester filament yarn substantially composed of polyethylene terephthalate is continuously false-twisted by means of a twister, a portion of the filament yarn in a region upstream of the twister is continuously heat-set by means of a non-touch type heater maintained at a temperature in a range of from 350° C. to 800° C. with a processing time in a range of from 0.04 second to 0.12 second, and then the heat-set portion of the yarn is detwisted in a region downstream of the twister to form a textured yarn.

According to the present invention, a textured yarn excellent in evenness for dyeability can be obtained and contamination of the heater surface can be avoided.

BRIEF DESCRIPTION OF THE DRAWINGS

Other objects and advantages of the present invention will be clearer from the following description with reference to the attached drawings, illustrating a preferred embodiment, wherein.

DESCRIPTION OF THE PREFERRED EMBODIMENT

"Polyester filament substantially composed of polyethylene terephthalate," according to the present invention, means a polymer of which more than 85% of its repeated units is composed of polyethylene terephthalate. The polymer may be copolyester having at least a copolymerized component. Further, the polymer may include additives commonly utilized in synthetic filaments, such as delusterants, anti-staticizers, anti-flammable agnets, and lubricants.

The false-twist texturing systems to which the present invention is applicable include both a single-heater type having only a primary heater and mainly used for producing a torque yarn and a double-heater type in which the torque yarn produced by a primary heater is continuously relaxed in a secondary heater to form a non-torque bulky yarn.

Figure 2:
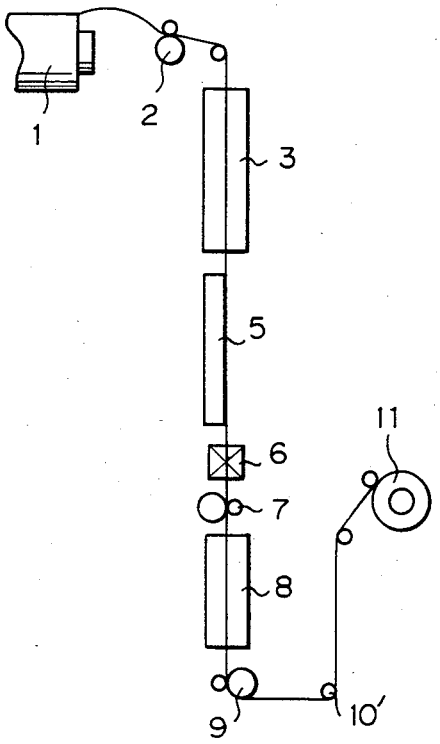
FIG. 2 is a schematic side view of a double-heater type false-twist texturing system adopted for carrying out the present invention.

A typical texturing system of the double-heater type is diagrammatically illustrated in FIG. 2, in which a primary heater 3, a cooling plate 5, a twister 6, and a secondary heater 8 are arranged in series. A POY is supplied from a package 1 into the processing zone through a feed roller 2 and is drawn between the feed roller 2 and a delivery roller 7 at a predetermined draw ratio. Simultaneously, the POY is false-twisted by the twister 6, and the twisted portion of the POY is heat-set by the primary heater 3. The POY then is cooled by the cooling plate 5 to fix the twisted form and is detwisted in the downstream region of the twister 6 to form a textured yarn. The textured yarn is introduced into the secondary heater 8 where the torque and bulkiness of the yarn are suppressed to form a non-torque yarn and is finally taken up by a winder 11 through a second delivery roller 9 and a guide 10.

The second heater 8 may be omitted, if control of the torque and bulkiness of the resultant yarn is unnecessary, whereupon the above system functions as a single-heater type.

Figure 3A:
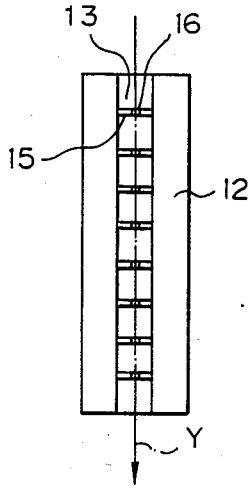
FIG. 3*a* is a front view of a non-touch type heater adopted for carrying out the present invention.
Figure 3C:
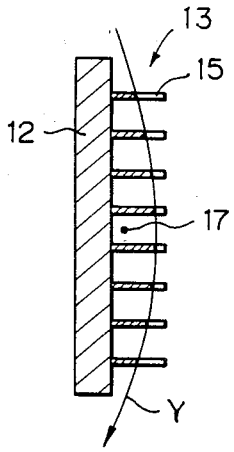
FIG. 3*c* is a sectional side view of the heater shown in FIGS. 3*a* and 3*b*.
Figure 3B:
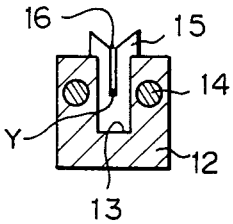
FIG. 3*b* is a sectional plan view of the heater shown in FIG. 3*a*.

In the present invention, the primary heater 3 must be of the non-touch type, one preferred embodiment of which is illustrated in FIGS. 3*a*, 3*b*, and 3*c*. A heater body 12 is provided along its length with a groove 13 in which a plurality of guide plates 15 are transversely positioned at substantially the same distance, such as 10 cm, from each other. The guide plate 15 has a central slit 16 therein. The slit 16 is formed with an increasingly greater depth toward the ends of the heater body 12. Therefore, the yarn Y to be processed stably passes through the heater 3 along a bow-like path without touching the heater surface, as shown in FIG. 3*c*, by being guided with the innermost point of each slit 16. Reference numeral 14 designates a sheathed heater embedded in the heater body 12. In the present invention, a "non-touch type heater" means a heater of the above type having a guide plate 15 for suppressing a balloon of the yarn in the heating zone and for completely preventing contact of the yarn with the heater.

The "heater temperature" means the temperature of the atmosphere in the groove 13 measured at the point designated by 17, in FIG. 3*c*. According to the inventor's experiments, however, the atmospheric temperature is almost the same everywhere in the groove 13.

Figure 4:
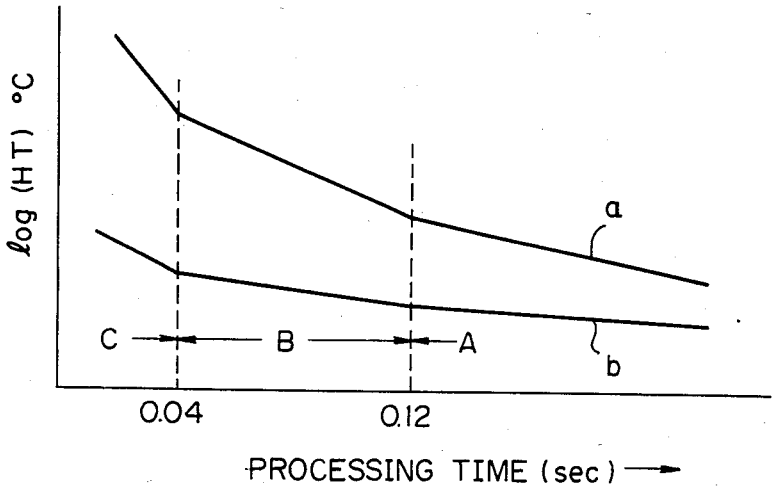
FIG. 4 illustrates curves representing the relationship of heater temperature under which the maximum crimpability of the resultant textured yarn is obtained to the processing time.

The heater temperature must be from 350° C. to 800° C. and the processing time for the yarn in the heater must be from 0.12 second to 0.04 second. According to the inventor's study, in false-twist texturing system for polyester filament, the logarithm of the heater temperature TH(°C.) under which the crimpability of the resultant textured yarn becomes maximum varies in relation to the processing time t, as shown in the graph in FIG. 4.

Figure 1A:
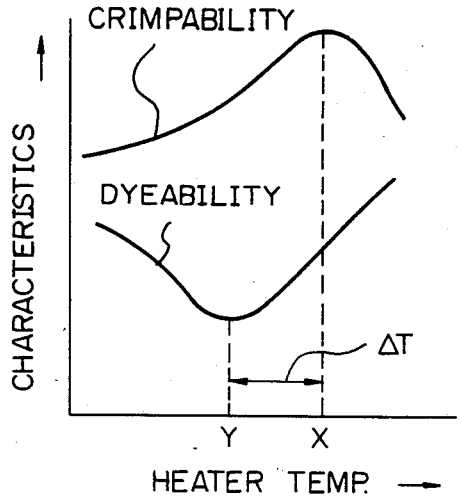
Fig. 1a PRIOR ART
FIG. 1*a* illustrates curves representing the relationship of the crimpability and dyeability to heater temperature according to the conventional texturing process.
Figure 1B:
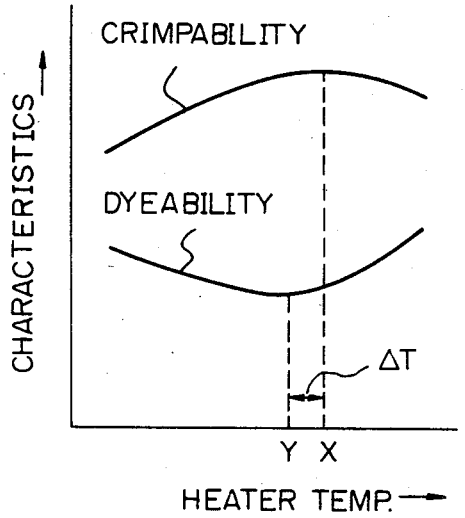
FIG. 1*b* illustrates curves similar with those of FIG. 1*a* according to the present invention.

Though the value of this maximum temperature for the non-touch type heater (curve a in FIG. 4) is always much higher than that of the contact-type heater (curve b in FIG. 4) because the former heater must energize the yarn only by heat radiation, the two curves are very similar to each other. Each curve can be split into three zones A, B, and C relative to the processing time according to their linear tendencies. The first zone A corresponds to a processing time of 0.12 second or more, which includes the conventional range. At any processing time in zone A, it has been observed that the peak temperature X for the crimpability and the valley temperature Y for the dyeability differ significantly, as described before by referring to FIG. 1*a*. Therefore, the process under zone A is unsuitable. In zone B, corresponding to the processing time between 0.04 second to 0.12 second, the two temperatures X and Y are observed to approach each other, and the two curves for crimpability and dyeability become flatter than those in zone A, as shown in FIG. 1*b*. This is novel information which can change conventional concepts in the field. The present invention is based on this new information.

If the contact-type heater is used in zone B, the heater temperature must be in the range of from 230° C. to 280° C. Under such a high temperature, the yarn easily melts when threaded to the heater at the commencement of operation, or yarn breakage occurs during operation and the yarn sticks on the heater surface. This is difficult to remove and can cause successive yarn breakage in the heater. Therefore, the contact-type heater is unsuitable for the present invention.

Contrary to this, in the case of non-touch type heater, though the preferable heater temperature, in the zone B, is from 350° C. to 800° C., the possibility of the yarn sticking on the heater surface is very low because the yarn path is separate from the heater surface. Even if the yarn touches the surface, it immediately burns up and leaves no foreign matter. Therefore, the non-touch type heater is suitable for the present invention.

As for zone C corresponding to a processihg time less than 0.04 second, the heater temperature must be very high, such as exceeding 800° C., which results in a large power consumption and shorter heater life. Moreover, the absolute value of the maximum crimpability becomes very low even under such a high heater temperature, because there is insufficient heat transmission from the heater to the yarn due to the shorter processing time.

Figure 5:
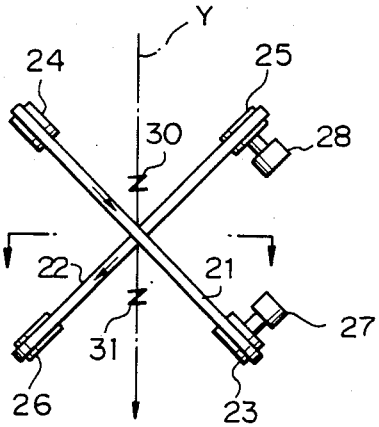
FIG. 5 is a schematic front view of a belt-type twister.
Figure 6:
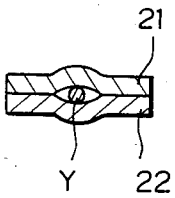
FIG. 6 is a sectional view of the belts, showing how a yarn is nipped by the belts.
Figure 7:
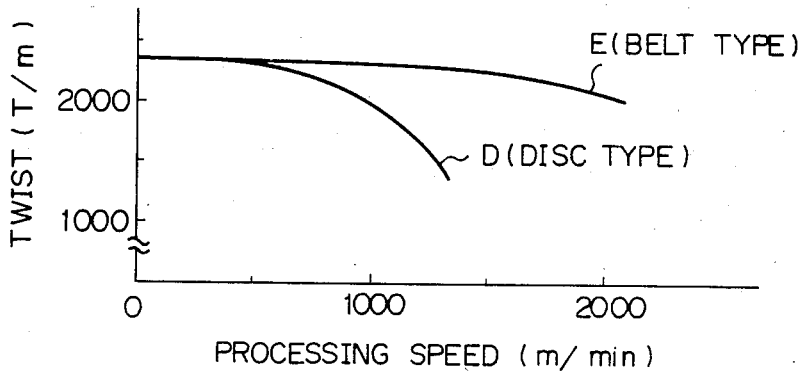
FIG. 7 illustrates curves representing the relationship between the twist number imparted by the twister and the processing speed of the yarn, showing a comparison between belt-type and disc-type twisters.

According to the present invention, the twister for false-twisting the yarn is preferably a belt type, in which yarn is twisted between a pair of endless belts. A typical structure thereof is illustrated in FIGS. 5 and 6, in which a pair of endless belts 21, 22 made of frictional material such as nitrile-butadiene rubber (NBR) with a hardness of 78° are driven by two pairs of pulleys 23, 24, and 25, 26, respectively. The two belts 21, 22, intersect each other with a specific angle $\theta$ and are driven in an opposite direction from each other by motors 27, 28, respectively. A yarn Y to be processed is introduced into the contact area between the two belts 21, 22 via an inlet guide 30, false-twisted while kept in a nipped state therebetween, and withdrawn therefrom via an outlet guide 31. As shown in FIG. 6, the belts 21, 22 are arranged to be able to tightly nip the yarn therebetween. This type of twister is excellent for its twisting ability, especially at a high processing speed. FIG. 7 is a graph of the twisting ability of the belt-type twister compared to a conventional three-disc type twister in the case of twisting a polyester filament of 150 d/30 f. As apparent from curve D, the ability of the conventional disc-type twister rapidly declining in the area of the processing speed exceeding 1,000 m/min. Contrary to this, as shown by curve E, that of the belt-type twister does not decline even in the area exceeding 2,000 m/min.

Figure 8A:
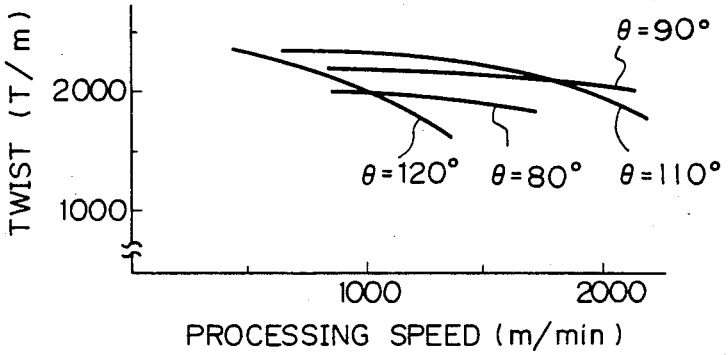
FIG. 8*a* illustrates similar curves, showing the comparison between various intersecting angles of the belt-type twister.
Figure 8B:
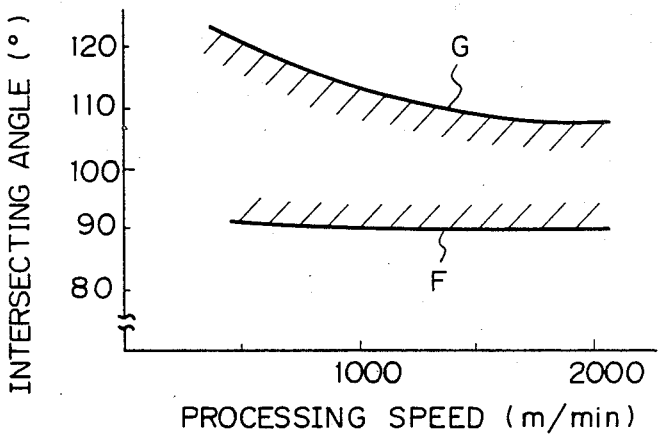
FIG. 8*b* illustrates a suitable range of the intersecting angle for the processing speed.

FIG. 8*a* illustrates the relationship between the twisting ability and the intersecting angle of the belts of the belt-type twister. It is apparent from the curves that, in the lower processing speed area around 500 m/min, the twisting ability becomes larger as the intersecting angle increases, but, in the higher processing speed area above 1,000 m/min, the tendency is not so simple. According to the study of the present inventors, it was found that there exists a suitable range for the intersecting angle relative to the processing speed, as shown in a graph of FIG. 8*b*, which is between two curves F and G. The lower curve F is determined by the minimum twist number required for obtaining an acceptable textured yarn, such as 2,200 T/m for a fully drawn polyester filament yarn of 150 d. On the other hand, the upper curve G indicates the maximum intersecting angle in which stable processing can be carried out. Naturally, the belt speed must be increased with the increase of the processing speed in order to smoothly propel the yarn. In the larger intersecting angle zone, however, the yarn cannot be stably twisted even if the belt speed is increased. The mechanism of this phenomenon is still unclear, but the fact teaches that the yarn must be twisted under the smaller intersecting angle with the increase of the processing speed. For this reason, an intersecting angle in a range of from 90° to 110° is preferable in the area exceeding a processing speed of 1,000 m/min.

Figure 9:
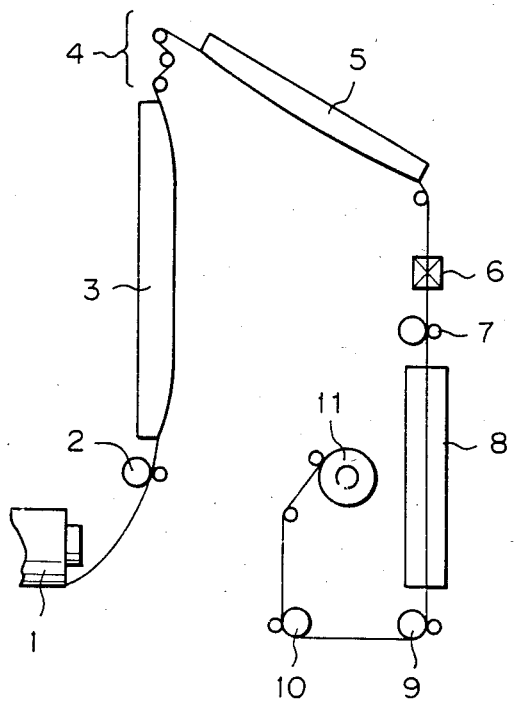
Fig. 9 PRIOR ART
FIG. 9 is a schematic side view of a typical in-draw texturing machine of the conventional type.

As stated above, according to the present invention, since the processing time in the heater zone is selected within a range of from 0.04 second to 0.12 second, which is much shorter compared to that of the conventional system, the length of the heater may be shortened even with a high processing speed. This results in more compactness of the overall texturing system. In this regard, for example, for a processing speed of 900 m/min, a heater length of at least 2.5 m is required in a conventional system. The entire installation of the same is as shown in FIG. 9, in which the yarn path must be bent acutely due to the overhead construction of the installation. On the contrary, according to the present invention, the heater length may be less than 1.8 m, typically from 65 cm to 70 cm which corresponds to the case of a processing speed of 400 m/min in the conventional system. Therefore, the installation becomes compact and the yarn path follows a substantially straight line, as shown in FIG. 2, which results in improved space efficiency and yarn quality. Moreover, according to the present invention, no scum cleaning of the heater is necessary, which is required in a conventional system every 10 or 30 days, because the scum does not stick at all on the heater surface due to usage of a non-touch type heater and the high temperature thereof.

The effects and advantages of the present invention will become clearer from the following examples:

EXAMPLE 1

Two kinds of POY's were obtained by melt-spinning polyethylene terephthalate polymer having an intrinsic viscosity [$\eta$] of 0.63, including 0.03 weight % of titanium oxide under a melting temperature of 295° C. and a spinning temperature of 285°, the POY's having a fineness of 115 d/36 f and 225 d/48 f and birefringence $\Delta n$ of 0.045 and 0.042, respectively. The POY's were subjected to an in-draw texturing process under various processing times by means of the same system as illustrated in FIG. 2 but without the secondary heater 8.

Processing Conditions

Draw ratio: 1.55

False-twist number:

The belt type twister was adjusted so as to impart the following twist to the yarn:

2300 T/m for 225 d POY

3200 T/m for 115 d POY

Kinds of heater:

The following four heaters were used.

1. Non-touch, 40 cm length
2. Non-tough, 70 cm length
3. Contact, 50 cm length
4. Contact, 100 cm length Heater temperature:

The heater temperature was set for the maximum crimpability in the resultant yarn under the corresponding processing time.

Apart from the above, the heater temperature for the minimum dyeability was sought for each processing time.

The textured yarns resulting from each run were tested for crimpability and tensile strength.

The results are summarized in Table 1.

TABLE 1

| Run No. | Starting yarn (d/f) | Kind and length of heater (cm) | Processing time and speed (sec., | m/min) | Heater temp. for max. crimpability (°C.) | Heater temp. for min. dyeability (°C.) | Difference ΔT between two temperatures (°C.) | Crimpability (%) | Tensile strength (g/d) |
|---|---|---|---|---|---|---|---|---|---|
| 1 | 225/48 | Non-touch 70 | 0.30, | 140 | 235 | 192 | 43 | 27 | 3.8 |
| 2 | " | " | 0.14, | 300 | 420 | 365 | 55 | 26 | 3.9 |
| 3 | " | " | 0.11, | 382 | 478 | 443 | 35 | 27 | 3.9 |
| 4 | " | " | 0.045, | 933 | 695 | 672 | 23 | 27 | 3.8 |
| 5 | " | " | 0.035, | 1200 | 810 | 775 | 35 | 22 | 3.2 |

TABLE 1-continued

| Run No. | Starting yarn (d/f) | Kind and length of heater (cm) | Processing time and speed (sec., | m/min) | Heater temp. for max. crimpability (°C.) | Heater temp. for min. dyeability (°C.) | Difference ΔT between two temperatures (°C.) | Crimpability (%) | Tensile strength (g/d) |
|---|---|---|---|---|---|---|---|---|---|
| 6 | " | Non-touch 40 | 0.18, | 133 | 360 | 310 | 50 | 26 | 3.7 |
| 7 | " | " | 0.08, | 300 | 575 | 545 | 30 | 27 | 3.8 |
| 8 | " | " | 0.05, | 480 | 675 | 650 | 25 | 27 | 3.8 |
| 9 | " | " | 0.03, | 800 | 880 | 845 | 35 | 18 | 3.0 |
| 10 | " | Contact 100 | 0.20, | 300 | 238 | 207 | 31 | 26 | 3.7 |
| 11 | " | " | 0.10, | 600 | 266 | 242 | 24 | 27 | 3.7 |
| 12 | " | " | 0.05, | 1200 | 298 | 276 | 22 | 26 | 3.6 |
| 13 | " | Contact 50 | 0.08, | 375 | 281 | 257 | 24 | 26 | 3.7 |
| 14 | " | " | 0.03, | 1000 | 330 | 307 | 23 | 19 | 3.1 |
| 15 | 115/36 | Non-touch 70 | 0.16, | 263 | 320 | 275 | 45 | 37 | 4.5 |
| 16 | " | " | 0.10, | 420 | 395 | 365 | 30 | 38 | 4.5 |
| 17 | " | " | 0.048, | 875 | 510 | 490 | 20 | 37 | 4.6 |
| 18 | " | " | 0.035, | 1200 | 575 | 555 | 20 | 29 | 3.6 |
| 19 | " | Non-touch 40 | 0.14, | 170 | 335 | 295 | 40 | 38 | 4.5 |
| 20 | " | " | 0.108, | 222 | 365 | 340 | 25 | 38 | 4.6 |
| 21 | " | " | 0.07, | 343 | 450 | 430 | 20 | 37 | 4.6 |
| 22 | " | " | 0.05, | 480 | 500 | 480 | 20 | 38 | 4.5 |
| 23 | " | " | 0.03, | 800 | 595 | 575 | 20 | 22 | 3.5 |

The crimpability was measured as follows:

1. The textured yarn is reeled in the form of a hank so that the total thickness thereof becomes 1500 denier.

2. The hank is treated in boiling water for 20 minutes while being subjected to a weight of 2 mg/d and is dried under 20° C. temperature and 65% relative humidity a day and night.

3. The treated hank is subjected to a weight of 200 mg/d for 1 minute. The length $l_0$ is measured in this state. Thereafter, the weight is replaced by a light weight of 2 mg/d. The length $l_1$ is then measured after 1 minute has passed. The crimpability TC is calculated by the following equation:

$$TC\,(\%) = \frac{l_0 - l_1}{l_0} \times 100$$

The dyeability was measured as follows:

1. The textured yarn is knitted to a tubular hose which is then scoured in water of 60° C. temperature and, thereafter, is dyed in a bath ratio of 100:1 with 4% of Polyester Blue GLF (tradename of dye marketed by Eastman Kodak) relative to the hose weight.

2. The dye solution is heated so that it reaches a boiling state from room temperature in 30 minutes and is kept in this state for 30 minutes.

3. Then, the hose is washed, spin-dried, and dried in a hot air drier at 100° C. temperature.

4. The lightness L of the dyed hose is measured by a spectrophotometer. As apparent from Table 1, in the runs where the processing time is longer than 0.12 second, the temperature difference ΔT was very large, exceeding 40° C., which causes unevenness of dyeability in the resultant textured yarn as stated before. On the contrary, when the processing time is shorter than 0.04 second, though the temperature difference was improved, the crimpability and the tensile strength become poor. These facts show that the processing time must be within a range of from 0.04 second to 0.12 second.

Even if the processing time falls within the above-mentioned range, the use of the contact-type heater was not preferable as shown by the case of run 11, 12, or 13. In such cases, scum was deposited on the heater surface and the yarn often melted and stuck thereto when yarn breakage occurred. Therefore, it is apparent that the non-touch type heater is necessary for processing the yarn under a higher temperature exceeding 230° C.

As a conclusion, runs 3, 4, 7, 8, 16, 17, 20, 21, and 22, circled in Table 1 and carried out under conditions according to the present invention, present superior results in yarn quality and heater contamination.

EXAMPLE 2

A POY of 225 d/30 f was spun under the same conditions as described in Example 1. The birefringence Δn thereof was 0.045. The POY was subjected to an in-draw texturing process by means of the same system as shown in FIG. 2 but without the secondary heater 8. The processing conditions were as follows:

Heater: Non-touch type, 1000 mm length
Intersecting angle of belts of the twister: 100°
Processing speed: 1400 m/min
Processing time: 0.0428 second
Heater temperature: 550° C.
Draw ratio: 1.5

Good quality textured yarn was obtained having a crimpability of 30% and uniform dyeability.

We claim:

1. A method for producing a textured yarn of polyester filament, wherein polyester filament yarn substantially composed of polyethylene terephthalate is continuously false-twisted by means of a twister and a portion of said filament yarn in a region upstream of said twister is continuously heat-set by means of a non-touch type heater maintained at a temperature in a range of from 350° C. to 800° C. with a processing time in range of from 0.04 second to 0.12 second, and then the heat-set portion of the yarn is detwisted in a region downstream of said twister to form a textured yarn.

2. A method according to claim 1, wherein said twister is a pair of friction belts intersectingly contacting each other.

3. A method according to claim 2, wherein said pair of friction belts is driven at a linear speed more than 1,000 m/min.

4. A method according to claim 2, wherein said friction belts intersect at an angle within a range of from 90° to 110°.

* * * * *